US006390781B1

(12) United States Patent
McDonough

(10) Patent No.: US 6,390,781 B1
(45) **Date of Patent: *May 21, 2002**

(54) SPA PRESSURE SENSING SYSTEM CAPABLE OF ENTRAPMENT DETECTION

(75) Inventor: William B. McDonough, Huntington Beach, CA (US)

(73) Assignee: ITT Manufacturing Enterprises, Inc., Upper Saddle River, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/708,201

(22) Filed: Nov. 7, 2000

Related U.S. Application Data

(63) Continuation-in-part of application No. 09/354,932, filed on Jul. 15, 1999.

(51) Int. Cl.[7] ..... F04B 49/06
(52) U.S. Cl. ..... 417/44.2; 210/86
(58) Field of Search ..... 417/44.2, 44.9; 62/238.6; 210/86, 742; 219/497; 4/493, 541.1

(56) References Cited

U.S. PATENT DOCUMENTS

| | | | | |
|---|---|---|---|---|
| 3,781,925 | A | 1/1974 | Curtis et al. | 4/493 |
| 4,322,297 | A | 3/1982 | Bajka | 210/742 |
| 4,676,914 | A | 6/1987 | Mills et al. | |
| 5,167,041 | A | 12/1992 | Burkitt, III | |
| 5,332,944 | A | 7/1994 | Cline | 310/339 |
| 5,410,150 | A | 4/1995 | Toron et al. | 250/227.22 |
| 5,585,025 | A | 12/1996 | Idland | 219/497 |
| 5,602,670 | A | 2/1997 | Keegan | 359/193 |
| 5,690,476 | A | 11/1997 | Miller | 417/44.2 |
| 5,725,359 | A | 3/1998 | Dongo et al. | 417/44.9 |
| 5,730,861 | A | 3/1998 | Sterghos et al. | 210/86 |
| 5,809,796 | A | 9/1998 | Zakryk | 62/238.6 |
| 5,898,958 | A | 5/1999 | Hall | 4/541.1 |
| 5,947,700 | A | 9/1999 | McKain et al. | |
| 6,003,166 | A | 12/1999 | Hald et al. | 4/541.1 |
| 6,059,536 | A | 5/2000 | Stingl | 417/44.2 |
| 6,227,808 | B1 * | 5/2001 | Mcdonough | 417/44.2 |

FOREIGN PATENT DOCUMENTS

| | | |
|---|---|---|
| EP | 0 863 278 A2 | 9/1998 |
| WO | WO 92/13195 | 8/1992 |
| WO | WO 98/36339 | 8/1998 |
| WO | WO/98/59174 | 12/1998 |

* cited by examiner

*Primary Examiner*—Teresa Walberg
*Assistant Examiner*—Leonid M Fastovsky
(74) *Attorney, Agent, or Firm*—Knobbe Martens Olson & Bear LLP

(57) ABSTRACT

A safety circuit for use with a spa system includes a pressure sensor which generates a signal representative of the pressure in the system. The safety circuit provides a constant current to the pressure sensor. A microcontroller is coupled to receive the signal from the sensor and is configured to store a first pressure level. The microprocessor compares the first pressure level with the subsequently measured pressure level and generates a control signal if the comparison indicates a change in pressure which exceeds a predetermined amount. The control signal is sent to a spa control circuit. An electronically controlled switch is coupled to receive the control signal from the microcontroller and turn electrical power to the pump off in response thereto.

20 Claims, 7 Drawing Sheets

SPA PRESSURE SENSING SYSTEM CAPABLE OF ENTRAPMENT DETECTION

The present invention is a continuation-in-part of the previously filed application entitled SPA PRESSURE SENSING SYSTEM CAPABLE OF ENTRAPMENT DETECTION filed Jul. 15, 1999 and assigned Ser. No. 09/354,932, which application is hereby incorporated by reference.

BACKGROUND OF THE INVENTION

1. Field of the Invention

This invention generally relates to spas and hot tubs and more specifically to control systems and circuits utilized in such spas and hot tubs.

2. Description of the Related Art

Pools, whirlpool spas, hot tubs and related systems typically include a tub for holding water, a pump for circulating the water and a heater. The pump draws water from the tub through a drain, forces the water through the heater and out through jets into the tub, thereby circulating the water and causing it to be heated by passing it through the heater.

When the pump is operating, personal contact with the drain can be dangerous, painful or even fatal. When the body or hair of a person is positioned in close proximity to the drain, the body or hair may completely or partially block the drain, thereby creating a vacuum or entrapment. This can cause entrapment of the person. Many pumps used in such systems, if obstructed, can draw a partial vacuum at the drain that may exert sufficient suction force to prevent a person from pulling free of the drain. Even if the person can pull free of the drain, bruises, welts, or other damage may result.

One approach to overcoming this safety hazard has been the use of multiple drains or suction ports and suction covers or grates which are formed to minimize the possibility of hair entanglement and prevent an airtight seal between a person's body and the drain. However, there are many systems still in use that were installed prior to the recognition of this safety hazard. It can be extremely difficult and expensive to rebuild or retrofit such existing systems to conform to modern safety regulations. Mechanical systems such as vacuum breakers and a Stengil switch can be retrofitted into such systems to give some measure of protection. However, such systems are not particularly sensitive to partial conditions of entrapment such as hair entanglement.

In addition, it is the current trend in safety regulations to require that such systems have a flow sensor. One use of flow sensors is to insure that water is flowing through the system and the heater before the heater is activated. Such flow sensors have typically been implemented as an electromechanical flow switch consisting of a microswitch activated by a diaphragm in contact with the water. These pressure switches are usually set to an arbitrarily low value, which may be 10 to 20 percent of the actual full pressure of the system in normal operation. Exceeding this low value is used as an indication that the pump is working. However, it is insufficient to detect significant pressure changes such as would be caused by partial entrapment.

In addition, it is required to supply electrical power to the pressure sensor and accompanying circuitry. To minimize the possible risk of electrocution, it is desirable to limit the amount of current at locations that could come in contact with water in the spa through a fault or failure.

SUMMARY OF THE INVENTION

The present invention provides a safety circuit which can send a signal to a control circuit to automatically remove electrical power from a device such as a pump in response to an indication of a change in the pressure in the circulating system.

The safety circuit can contain a sensor that generates a signal representative of the pressure generated by the pump. A microcontroller is coupled to receive the signal from the sensor and is configured to store a first level indicative of a signal received from the sensor at a first time. The microcontroller is configured to compare the first level with a second level indicative of a signal received from the sensor at a second time. The microcontroller is configured to generate a control signal when the comparison between the two levels indicates a change in pressure which exceeds a predetermined amount of change. The microcontroller sends the control signal to the spa control circuit. The spa control circuit controls the application of electrical current to the pump. An electrically controlled switch is coupled to receive a signal from the spa control circuit and is configured to control application of electrical power to a device, such as a pump, in response to that signal.

In one aspect of the invention the sensor is a pressure sensor which is capable of producing a signal representative of changes in pressure in the spa system. The safety circuit can be used to detect conditions of entrapment or partial entrapment and immediately shut off the pump in the spa when such conditions are detected.

In another aspect of the invention, the safety circuit contains a constant current source to limit the electrical current available at locations that could come in contact with water.

These and other features and advantages of the invention will be readily apparent to those skilled in the art from the following detailed description of embodiments of the invention with reference to the accompanying drawings.

DETAILED DESCRIPTION OF THE PREFERRED EMBODIMENT

The invention provides a safety system including a pressure or vacuum sensor and an associated safety circuit, which can be connected with a spa control circuit in a tub, spa, or similar system, which uses a pump to circulate water. Spas, hot tubs, pools and similar systems are generally referred to herein as spas. The spa control circuit implements the normal functions required of a modem digital spa or pool control including pump control, water flow detection and heat control. The safety system rapidly detects conditions that are indicative of entrapment brought about by a person being trapped or partially trapped against the suction of the pump. When the safety system detects entrapment, a signal is sent to the spa control circuit and the pump is immediately shut off.

Figure 1:
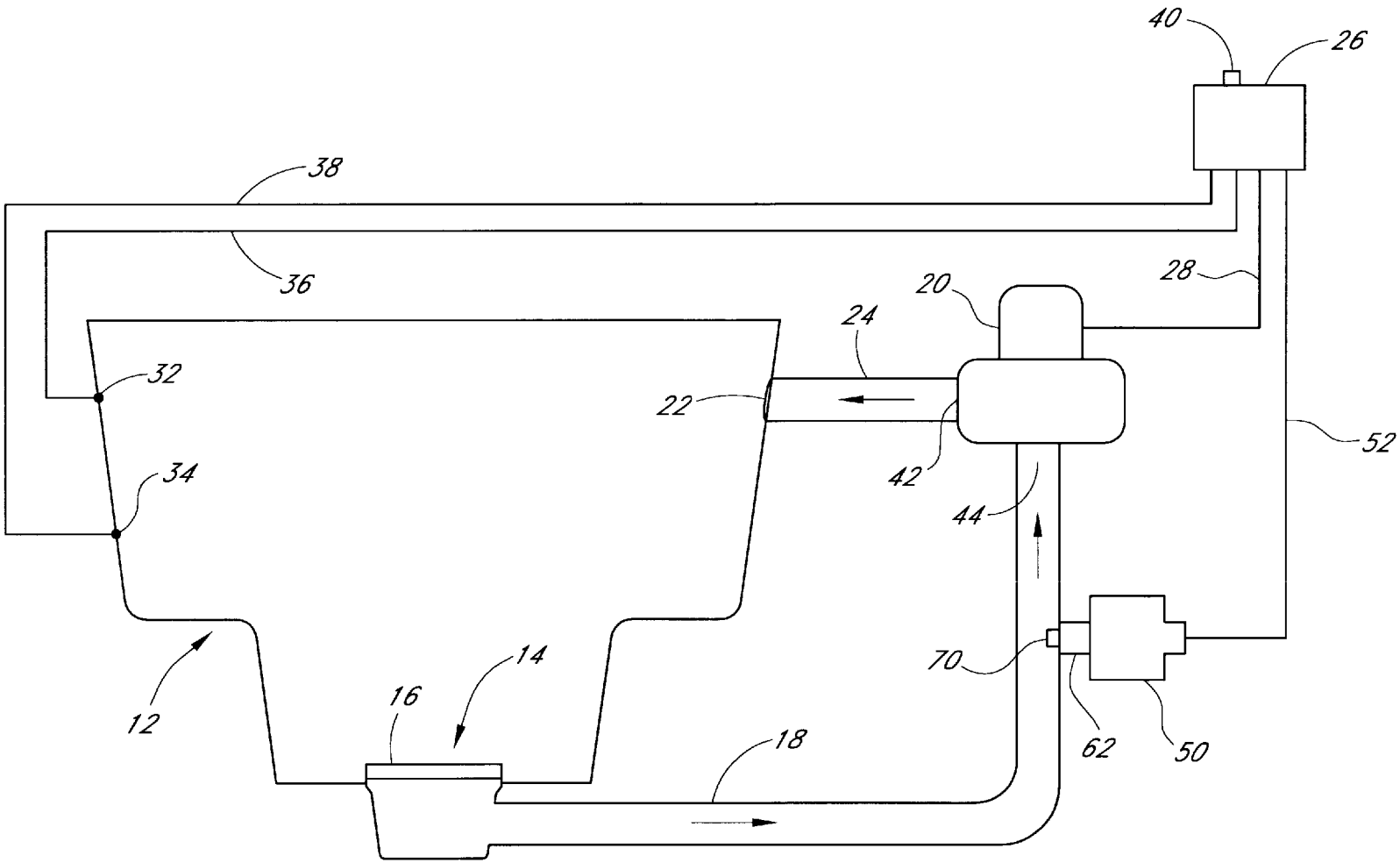
FIG. 1 is a block diagram of a spa employing the invention.

Referring to FIG. 1, the overall configuration of a spa utilizing the present invention will be described. The spa includes a tub 12, having at its bottom a drain 14. A suction cover 16 covers the drain 14. A return pipe 18 couples the drain 14 of the tub 12 to the input of a pump 20. The output of the pump 20 is coupled to a return jet 22 via an exhaust pipe 24. The circulating system of the spa of includes the return pipe 18, the pump 20 and the exhaust pipe 24. A single jet 22 is shown for ease of description, though most spas employ multiple jets. Similarly, some spas also employ multiple drains. The safety system 50 is connected to the return pipe 18 near the input of pump 20.

A spa control circuit 26 provides electrical power to the pump via electrical line 28. The spa control circuit 26 receives its electrical power from an alternating current source, such as a typical wall outlet (not shown). The spa control circuit provides electrical power to the safety system 50 via electrical line 52. The spa control circuit 26 can control various functions of the spa such as lights, a heater and other functions.

Figure 2:
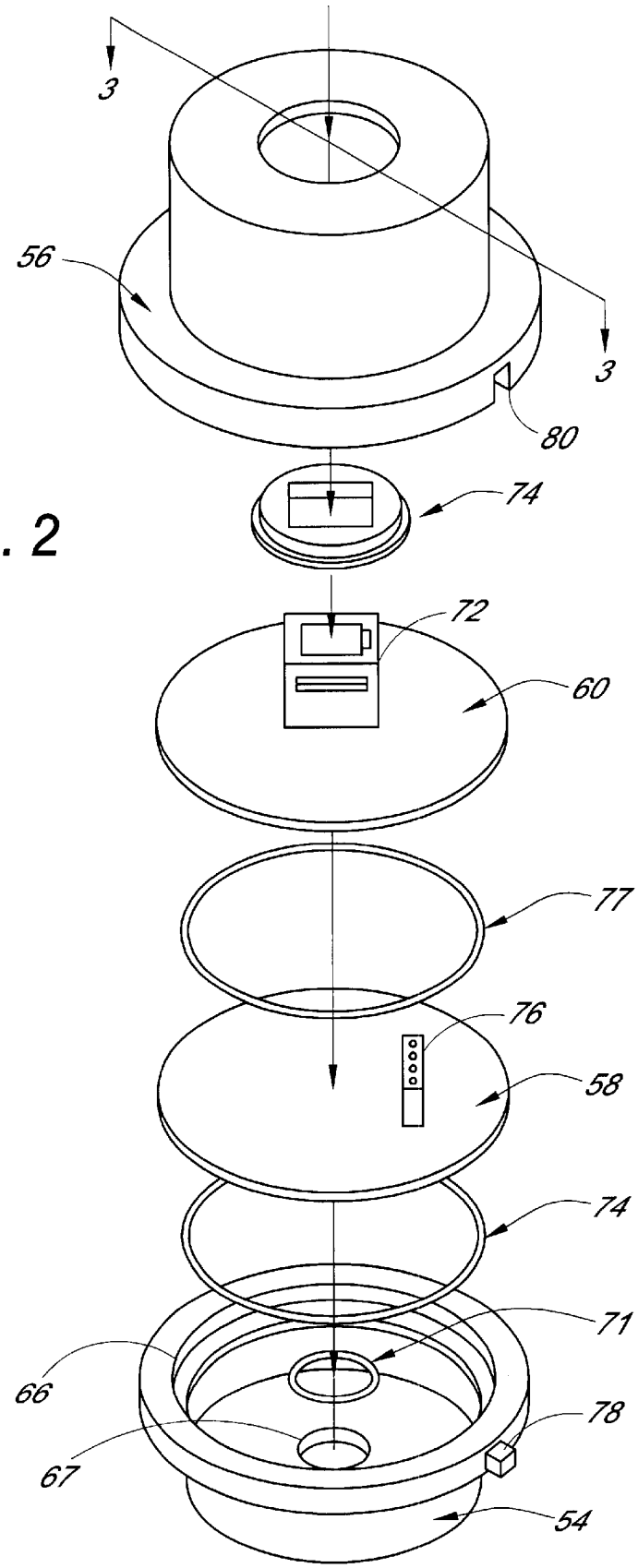
FIG. 2 is an exploded perspective view of one embodiment of the safety system.

FIG. 2 illustrates one embodiment of the safety system 50 which includes a lower case 54, an upper case 56, a first circuit board 58 and a second circuit board 60. An RJ type connector 72 is mounted on the top surface of the second circuit board 60. The connector 72 forms one end of the connection between the safety system 50 and the spa control circuit 26. An adapter 74 fits over the outer portion of the RJ type connector 72 and mates with an opening in the top surface of the upper case 56.

The lower case 54 can be glued to the upper case 56. Other ways of attaching the lower case 54 to the upper case 56 can also be used. Preferably, the outer surface of the lower case 54 has two protrusion locks 78, spaced 180 degrees apart. The two locks 78 slidably fit into two groves 80 in the upper case 56 to securely fasten the lower case 54 to the upper case 56 in a defined relationship.

Figure 3:
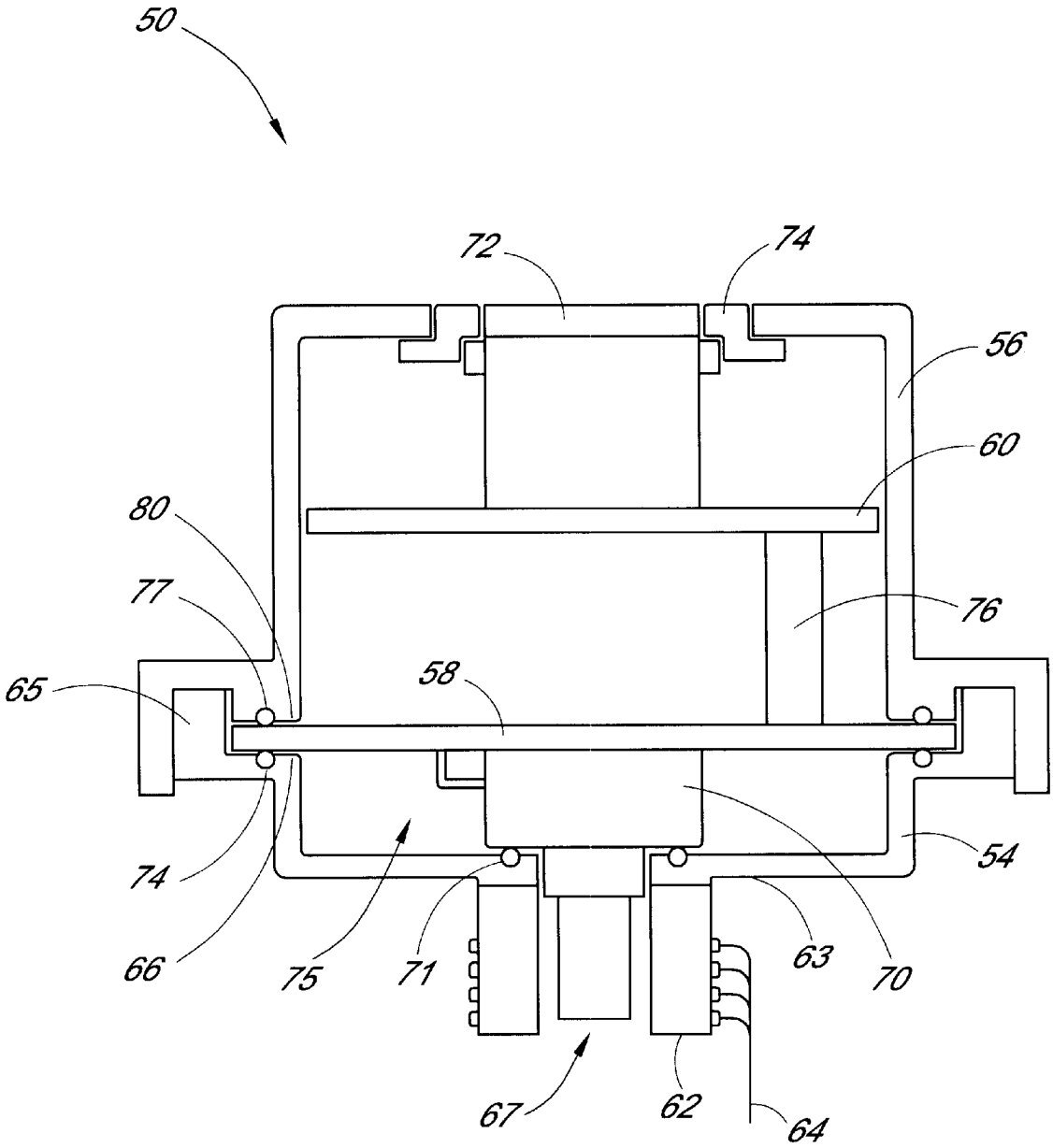
FIG. 3 is a cross sectional view of the device shown in FIG. 2 taken along line 3–3.

Turning now to FIG. 3, a hollow narrow neck 62 extending outwardly from a first end 63 of the lower case 54 is shown. The narrow neck 62 has threads 64 on the outside to enable the safety system 50 to be screwed into a threaded fitting, such as a reducing tee, in the suction pipe 18 (see FIG. 1). Alternately, the narrow neck 62 can have threads on the inside to engage the fitting or it can be smooth and bonded to a fitting on the suction pipe 18 by an adhesive. Near a second end 65 of the lower case 54, a lower lip 66 is formed on the interior surface of the lower case 54. The first circuit board 58 is seated on the lower lip 66.

A pressure sensor 70 is mounted on the side of the first circuit board 58 facing the narrow neck 62. The hollow narrow neck 62 has an opening 67 sized to receive a portion of the pressure sensor 70 so that one end of the pressure sensor 70 is protruding into and in fluid connection with the water in suction pipe 18 (see FIG. 1.) The pressure sensor 70 can be a conventional strain/gage bridge device implemented with piezo resistive material. Such devices are available from manufacturers such as Honeywell, Motorola, and Lucas. For example, Honeywell manufacturers such a sensor identified as model 22PC. Alternatively, a pressure sensor device that produces an electrical output representative of pressure and/or changes in pressure can also be used.

A first flexible seal 71, such as an o-ring, is compressed between the bottom surface of the lower case 54 and the pressure sensor 70 to provide a watertight seal. A second flexible seal 74, such as an o-ring, is compressed between the first circuit board 58 and the lower lip on the lower case 54, providing a further watertight seal. An air chamber 75 is formed between the first circuit board 58 and the base of the lower case 54 to collect any water leakage past the first flexible seal 71, thereby protecting the rest of the safety system 50 from contact with and possible damage from water.

The upper case 56 has a fist end with a diameter slightly larger than the diameter of the second end of the, lower case 54 so that the upper case 56 receives a portion of the lower case 54. A third flexible seal 77, such as an o-ring, is compressed between first circuit board 58 and a lip 80 on the interior surface of the upper case 56 to form a watertight seal.

The second circuit board 60 is housed in the upper case 56. A four-pin ribbon cable 76 electrically connects the second circuit board 60 with the first circuit board 58.

The ribbon cable 76 provides a flexible connection, so an exact alignment of the first and second circuit boards 58, 60 is not required. Alternately, other suitable electrical connectors can be used.

Figures 4, 4A:
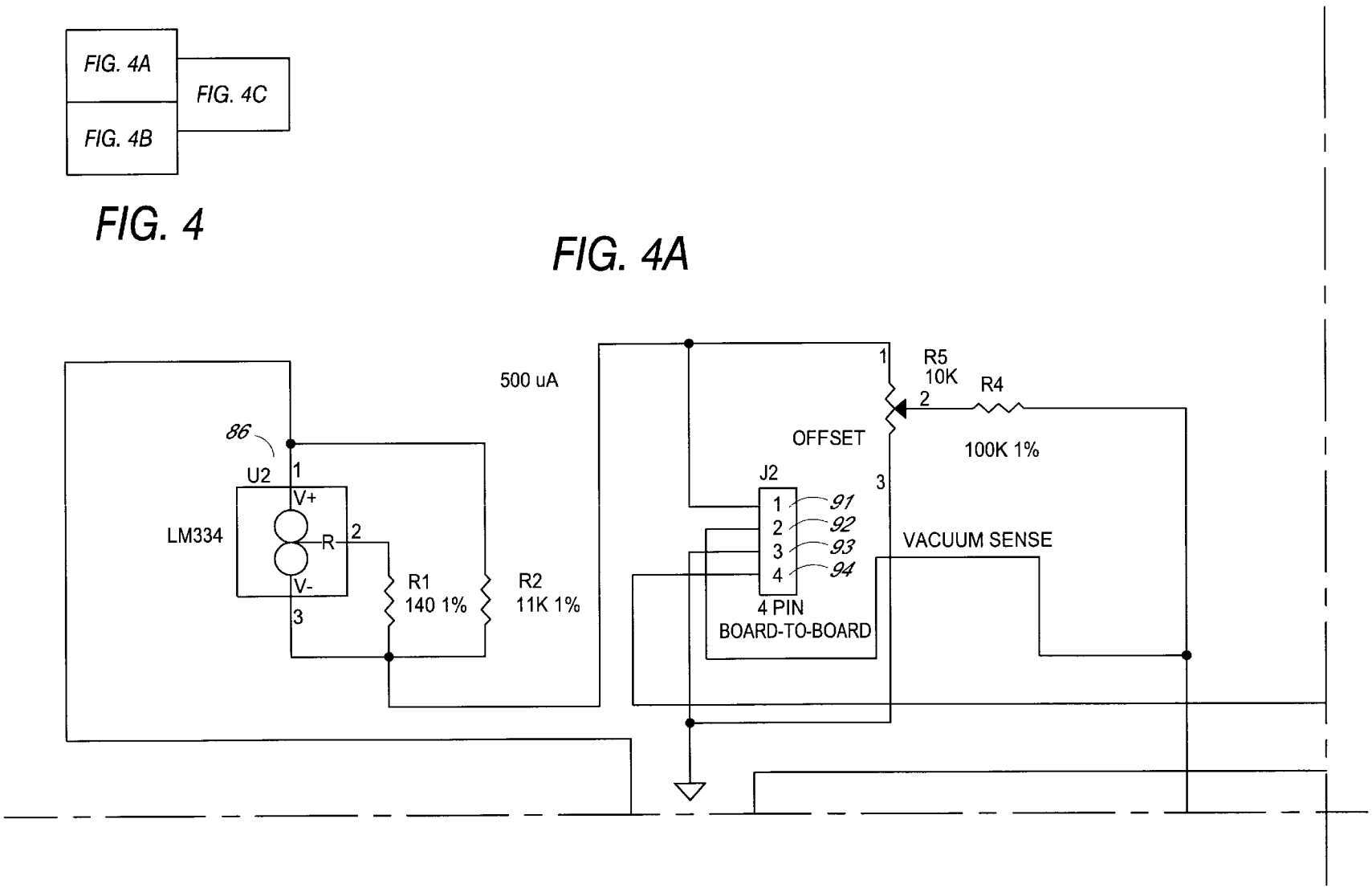
FIG. 4 is a detailed circuit diagram of a circuit embodying aspects of the safety system.
Figure 4B:
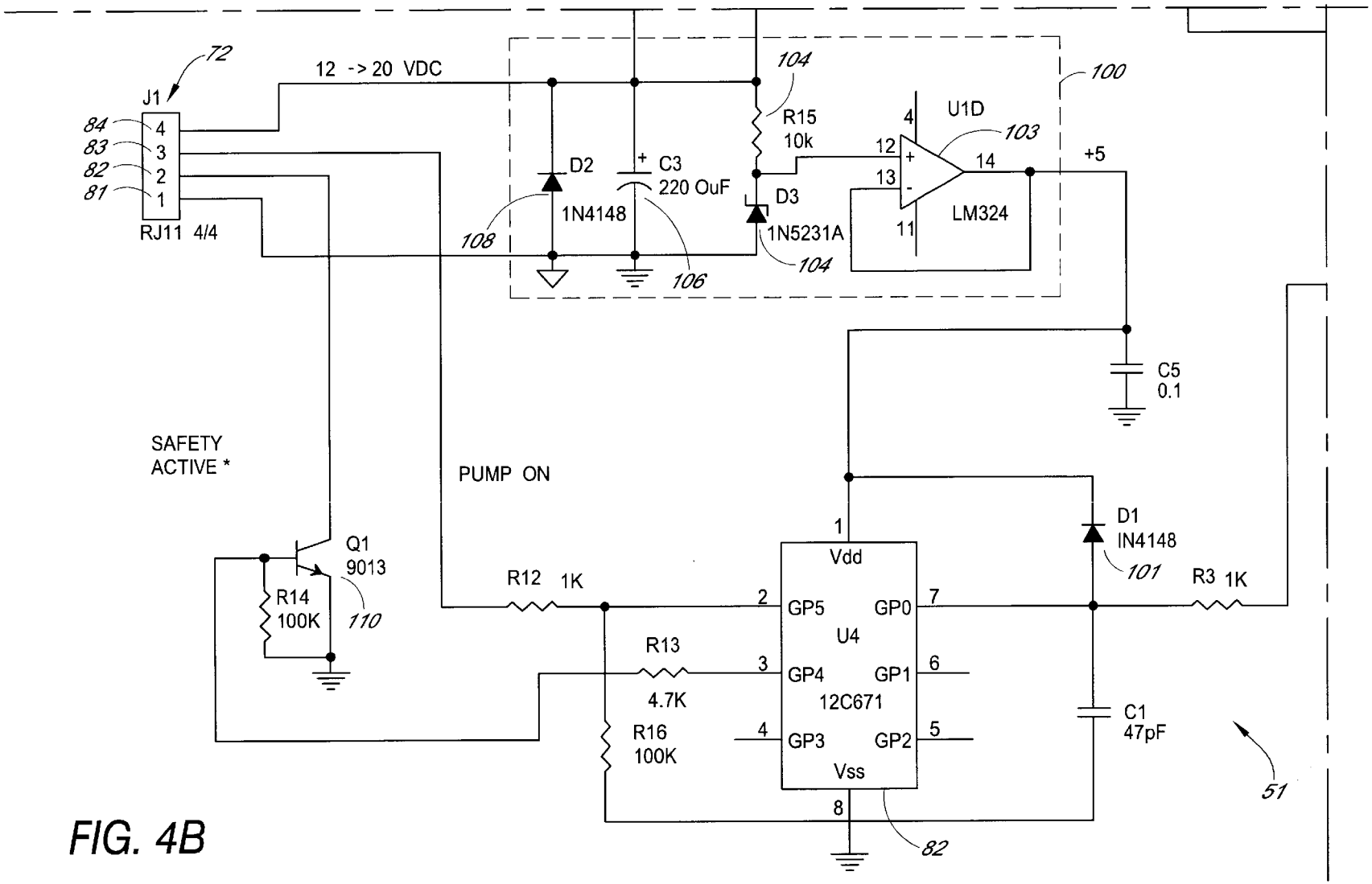
Figure 4C:
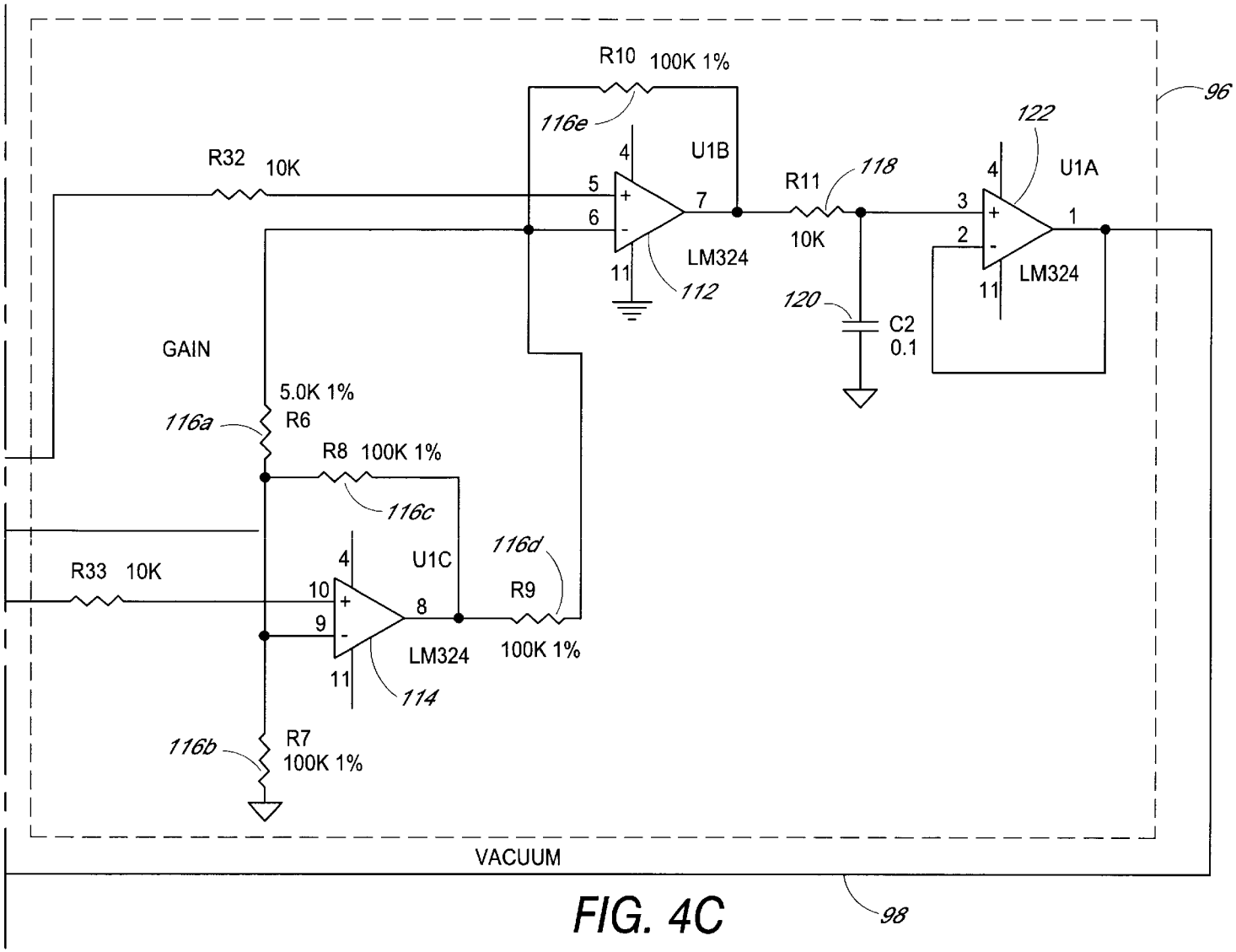

FIG. 4 illustrates a schematic depiction of an embodiment of a safety circuit 51 that can be located on the second circuit board 60 of FIG. 2. The safety circuit 51 includes a voltage regulator 100, a microcontroller 82, a constant current source 86, and a differential amplifier 96.

The connector 72 (see FIG. 2) can be an RJ11 connector. An input voltage, typically 12–20 volts-DC, is applied to the safety circuit 51 through input terminals 81, 84 on the RJ11 connector 72.

The input voltage across input terminals 81, 84 on the RJ11 connector 72 is applied to the voltage regulator 100. Operational amplifier 103 in cooperation with a Zener diode (D3) 102 and a resistor (R15) 104 cooperate to form the voltage regulator 100. The voltage regulator 100 produces a constant, regulated 5-volt DC output appropriate for use with microcontrollers. The voltage regulator 100 can include one of the four operational amplifiers of a quad operational amplifier LM324. A filtering capacitor (C3) 106 cooperates with the voltage regulator 100 in providing a well-regulated 5-volt DC output. The capacitance of the capacitor 106 can be 220 micro-farads. Diode (D2) 108 is placed between the outputs of input terminals 81, 84 to provide reverse voltage protection.

The 5-volt DC power is supplied to the microcontroller 82. The microcontroller 82 can be a microcontroller model 12C671 8-byte microcontroller from Microchip Technology, Inc. or any other suitable commercially available microcontroller or microprocessor.

The input voltage across input terminals 81, 84 on the RJ11 connector 72 is also applied to the constant current source 86 that produces a constant current of, for example, 490 microamperes. Other suitable constant current levels can be used, but a constant current of less than 500 microamperes is highly desirable to minimize the risk of electrocution should the first circuit board 58 come in contact with water from the spa. The constant current source 86 can be a LM334 or similar device.

The constant current of, for example, 490 microamperes is applied to the pressure sensor 70 through input pin 94 and ground through input pin 92 across the 4-pin ribbon cable 76. The differential voltage across the outputs 91, 93 of the pressure sensor 70 are supplied to an instrumentation differential amplifier 96. An output signal 98 from the differential amplifier 96 is supplied to the microcontroller 82. The output signal 98 of the pressure sensor 70 is a differential resistance change that is approximately linearly proportional to the pressure force (or vacuum force) of the water pressure applied to the pressure sensor 70.

The differential amplifier 96 can be implemented using three of the operational amplifiers of an integrated circuit quad operational amplifier. A quad operational amplifier such as LM324, which is manufactured by National Semiconductor, among others, can be used for this purpose. [Bill, can you add more info on how the differential amplifier works, i.e. how the output is filtered. What is the purpose of the resistors R7, R8, R9, R10. What is the purpose of Capacitor C2]

The output signal 98 is clamped to no higher than 5.1 volts by diode (D1) 101 placed in a line connecting the output signal with the output of the voltage regulator. 100 to protect the microcontroller 82 from spikes from the differential amplifier 96. The microcontroller 82 receives the output signal 98.

The microcontroller 82 provides a control signal to the spa control circuit 26 through a transistor (Q1) 110. The transistor 110 electrically isolates the microcontroller 82 from the spa control circuit 26. The transistor 110 operates like a switch and allows current to flow to the spa control circuit output terminal 82 of the RJ11 connector 72 when the microcontroller 82 applies a logic high signal to the transistor 110. The microcontroller 82 applies a logic high signal when no entrapment problem is detected. When an entrapment problem is detected, a logic low signal is sent, the transistor 110 no longer allows current to flow to the spa control circuit 26 and the spa control circuit 26 shuts off the pump 20.

Describing the operation of the safety system 50 in the spa system, when the pump 20 is operating, water is drawn in through the drain 14, travels through the suction pipe 18 where it enters the pump 20. The pump 20 pushes the water through the exhaust pipe 24 and out through the jet 22 back into the tub 12. In addition, the spa may include a heater, electrical lights and other enhancements known to those of skill in the art. Those elements are not represented in FIG. 1 for ease of description.

The spa control circuit 26 controls the application of electrical power to the pump 20. An on/off switch 40 can be activated by a user to turn the pump on. Before providing electrical power to the pump 20, the spa control circuit 26 first determines if the water level in the tub is sufficiently high to cover the jet 22. The water level is detected using circuitry not shown.

After water is detected in the tub, the spa control circuit 26 applies electrical power to the pump 20. The pump then begins pushing water through the system which increases the water pressure on the outlet side 42 of the pump 20 at the same time decreasing the pressure (increasing the vacuum level) on the inlet side 44 of the pump.

During normal operation, the microcontroller 82 checks the vacuum at the input side of the pump 20 very frequently, for example, dozens of times per second. The sensed pressure is compared against the baseline originally acquired and stored. If a decrease in pressure of more than a predetermined amount from the baseline occurs for example, 20%, and lasts for more than a pre-determined time, for example, 0.1 seconds, the microcontroller 82 sends a signal to the spa control circuit 26, which shuts off power to the pump 20. Alternatively, any two or more measurements or indications of the pressure separated in time can be compared to determine whether there has been a change in pressure. If the change in pressure exceeds a predetermined amount, the safety system 50 sends a signal to the spa control circuit 26, which shuts off power to the pump 20. Of course, one skilled in the art could assemble numerous variations of specific circuits to carry out these functions.

Figure 5:
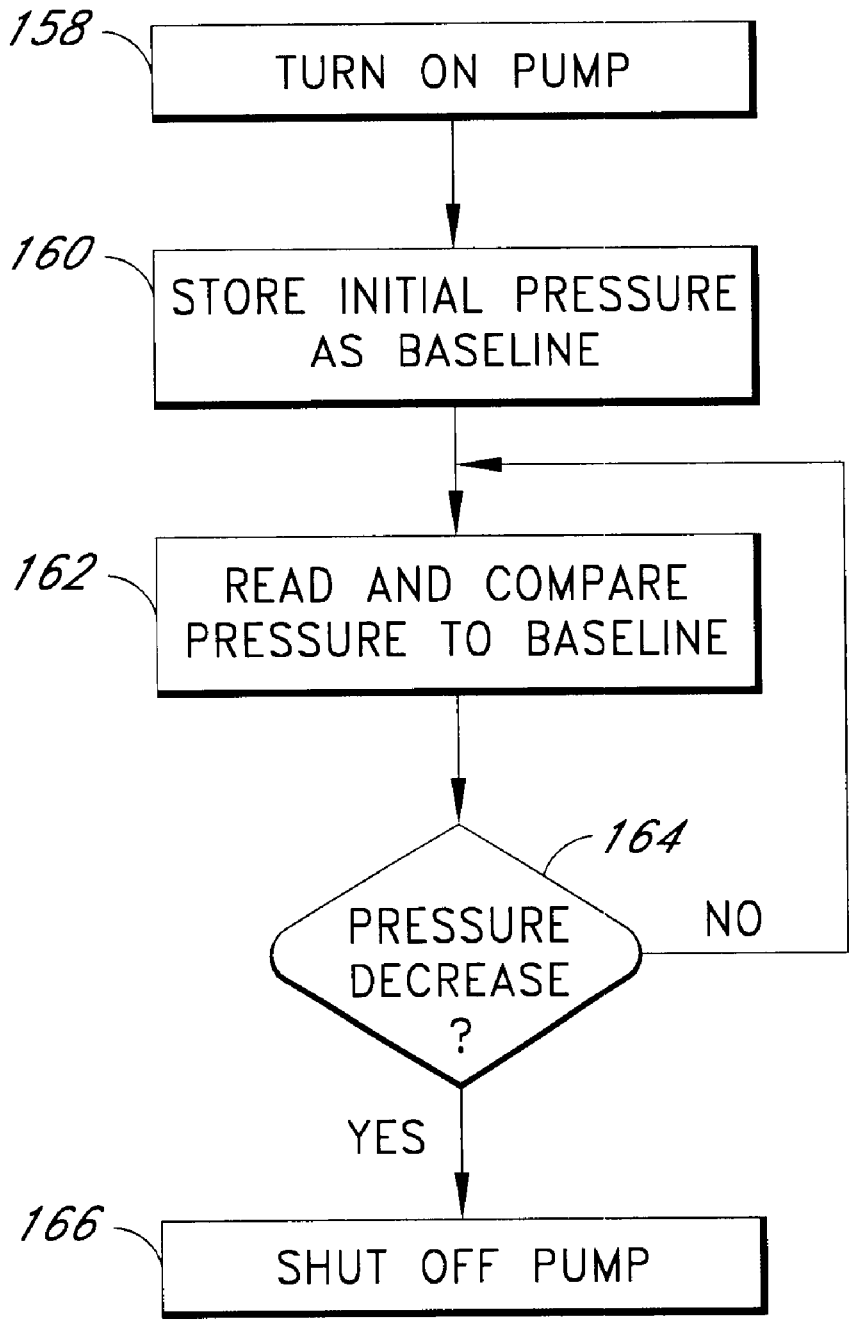
FIG. 5 is a flow diagram of the operation of the circuit of FIG. 4.

Referring now to FIG. 5, operation of the safety circuit 51 depicted in FIG. 4 will be described. Operation of the spa control circuit 26 can be controlled by software or firmware running on the spa control circuit. The software can be stored on a suitable storage device such as ROM or RAM or other computer memory and can be in the form of a software module.

When the pump 20 is turned on and begins pushing the water through the spa system, water pressure is increased on the outlet side of 42 of the pump 20 while the pressure level on the inlet side 44 of the pump 20 decreases, represented by block 158.

A predetermined time after the pump is turned on, such as 2 seconds, the microcontroller 82 acquires the pressure level at that time from the pressure sensor 70, via the differential amplifier 96. The microcontroller 82 stores that initial or first pressure level, for example, in the microcontroller's random access memory (RAM), for use as a baseline for future reference as is represented by block 160. This initial pressure level can be different for each spa system in which the safety circuit 51 is utilized. The differences in initial pressure levels can be because of differences between spas, for example in the diameter and length of their plumbing, the horsepower-rating of pump motors, variations in pump design, the amount of the restriction in the jet plumbing, etc.

Storing the baseline pressure level provides an important self-calibration function. This capability allows the safety circuit 51 to be used with different pumps, plumbing arrangements, tubs, etc., because the safety circuit 51 does not require a preset calibration. In addition, this allows the safety circuit 51 to adapt to long-term changes in the overall performance of the spa system such as decreased pump output which can occur as filters become clogged during normal operation.

After the baseline pressure level has been acquired, the microprocessor 82 periodically reads the current pressure level via the pressure sensor 70, for example, two to 500 times per second. The current pressure level is compared to the baseline pressure level previously stored as represented by block 162. Alternatively, the microcontroller can compare any two pressure level readings separated in time. The microcontroller determines whether there has been a decrease in the pressure level below the baseline as represented by block 164. A decrease of or in excess of a predetermined amount, such as a 20% decrease below the stored baseline, can be used as an indication that an entrapment has occurred. A percentage change or an absolute change can be used.

When such a decrease in pressure is detected, the microcontroller immediately shuts off the pump 20 as represented by block 166. The microcontroller 82 sends a signal to the spa control circuit 26 to shuts off the pump 20 by sending a logic-LOW signal to the transistor 110.

In addition to selecting a predetermined decrease in pressure, a time requirement can also be included. The microcontroller 82 can use both the detection of a pressure level in excess of the predetermined decrease level and the duration of the decrease in the pressure for determining when to shut off the pump. For example, the microcontroller 82 can be programmed to ignore decreases in the pressure which have a duration shorter than 0.1 seconds. If the decrease in the pressure does not exceed the predetermined decrease and/or does not exceed a predetermined time interval, the microcontroller 82 then continues to regularly read and compare the current vacuum level.

Therefore, the safety circuit 51 provides a safety feature of turning off the pump 20 upon the detection of entrapment and/or complete or partial blocking of the drain 14 of the spa system. In addition, the safety circuit 51 can be utilized with many different pumps, plumbing configurations and types of spas because it is self-calibrating upon start-up. It is therefore very convenient for the retrofitting of older installed spa systems.

Though the foregoing embodiment has been described with regard to detecting changes in pressure (increases in vacuum level) on the inlet side of the pump, the system can also be implemented based upon changes in pressure at the output 42 of pump 20. However, there may be a slight delay between a decrease in pressure on the inlet side of the pump and the corresponding decrease in pressure on the outlet side of the pump. As was note above, various sensors for detecting different measurements or indications which relate to or can be correlated with the pressure in the spa system can also be used. In addition, the foregoing embodiment has been described with regard to controlling a pump. However, the same flow detection and control of a device such as a pump in accordance with the flow detection can also be applied to the control of other spa devices such as a heater and can be used to control multiple devices such as a pump and a heater.

The invention may be embodied in other specific forms without departing from its spirit or essential characteristics. The described embodiments are to be considered in all respects only as illustrative and not restrictive. The scope of the invention is indicated by the appended claims rather than by the foregoing description. All changes and variations which come within the meaning and range of equivalency of the claims are to be embraced within their scope.

What is claimed is:

1. A safety control circuit for use with a spa system having a spa control circuit and a pump for circulating water through the spa system, the safety circuit comprising:

at least one pressure sensor capable of producing a signal representative of changes in pressure in the spa system;

a microcontroller coupled to receive the signal from the pressure sensor, programmed to store a first pressure, compare the first pressure with a subsequent pressure and generate a control signal when the comparison indicates a change in pressure which exceeds a predetermined amount;

a constant current source coupled to said pressure sensor.

2. The safety circuit of claim 1, wherein said constant current source provides a current less than 501 microamperes.

3. The safety circuit of claim 1, wherein said pressure sensor comprises a strain/gage bridge device.

4. The safety circuit of claim 1, wherein said pressure sensor, comprises piezo resistive material.

5. The safety circuit of claim 1, further comprising an amplifier coupled to receive the output signal of the pressure sensor.

6. A safety circuit for use with a spa system having a circulating system including a pump for circulating water through the spa system, the safety circuit a comprising:

at least one sensor capable of producing a signal representative of the pressure generated by the pump;

A differential amplifier coupled to said sensor and capable of receiving and amplifying said signal;

a constant current source coupled to said sensor;

a microcontroller coupled to receive said amplified signal from the differential amplifier, and configured to store a first level indicative of a signal received from the differential amplifier at a first time, compare the first level with a second level indicative of a signal received from the differential amplifier at a second time and generate a control signal when the comparison indicates a change in pressure which exceeds a predetermined amount of change; and a voltage regulator coupled to said constant current source and said microcontroller.

7. The safety circuit of claim 6, wherein said control signal controls the application of electrical power to the pump.

8. The control circuit of claim 6, wherein said constant current source provides a maximum of 500 microamperes.

9. The control circuit of claim 6, wherein said sensor comprises a strain/gage bridge device.

10. The control circuit of claim 6, wherein said sensor comprises a flow meter.

11. A spa system comprising:

a main switch which controls the flow of electrical power to the spa system;

a water pump coupled to the main switch;

a safety circuit comprising at least one sensor which produces an electrical signal representative of the pressure generated by the pump, and a microcontroller coupled to receive the signal from the at least one sensor, said microcontroller including a stored program which when executed by the microcontroller causes the microcontroller to store an initial pressure level and generate a control signal when the initial pressure level varies by a predetermined amount;

a constant current source for supplying electrical power to said sensor; and a spa control circuit comprising a switch mechanism responsive to said control signal which controls the application of electrical power to the pump in response thereto.

12. The spa system of claim 11, further including a heater.

13. She spa system of claim 11, wherein said constant current source provides a maximum of 500 micro amperes.

14. The spa system of claim 11, wherein said sensor comprises a strain/gage bridge device.

15. The control circuit of claim 11, wherein said sensor comprises a flow meter.

16. A method for controlling the flow of electrical power to a device in a spa system, comprising:

supplying electrical power to a pump of the spa system;

supplying a constant current to a sensor that measures the pressure generated by the pump;

storing a first pressure level representative of the pressure generated by the pump at a first time;

comparing the first pressure level with a second pressure level representative of the pressure generated by the pump at a time subsequent to the first time; and stopping the flow of electrical power to the pump if the comparison indicates a change in pressure which exceeds a predetermined amount of change.

17. The method of claim 16, further comprising repeatedly measuring the second level indicative of a signal received from the sensor at a second time and comparing the second level to the first level.

18. The method of claim 16, further comprising determining if sufficient water is present in the spa system.

19. The method of claim 16, further comprising supplying a current less than or equal to 500 microamperes to said sensor.

20. A safety circuit for a spa having a circulating system including a pump, the circuit comprising:

a power source; and an entrapment sensor circuit comprising a pressure sensing element which responds to the pressure in said circulating system, a constant current source for providing electrical power to said pressure sensing element, and a circuit interrupter, connected in series between said power source and said pump, which disconnects said power source from said pump when the pressure in said circulating system of said spa heater changes more than a predetermined amount from an initial pressure.

* * * * *

UNITED STATES PATENT AND TRADEMARK OFFICE

CERTIFICATE OF CORRECTION

PATENT NO. : 6,390,781 B1
DATED : May 21, 2002
INVENTOR(S) : Mc Donough

It is certified that error appears in the above-identified patent and that said Letters Patent is hereby corrected as shown below:

Column 2,
Line 58, change “modem” to -- modern --.

Signed and Sealed this

Thirtieth Day of July, 2002

*Attest:*

*Attesting Officer*

JAMES E. ROGAN
*Director of the United States Patent and Trademark Office*